United States Patent [19]

Zehner, Jr.

[11] Patent Number: 4,880,255

[45] Date of Patent: Nov. 14, 1989

[54] MULTIPLE PLY BUSINESS FORM

[75] Inventor: George F. Zehner, Jr., Crystal Lake, Ill.

[73] Assignee: Uarco Incorporated, Barrington, Ill.

[21] Appl. No.: 289,699

[22] Filed: Dec. 27, 1988

[51] Int. Cl.[4] ..... B41L 1/20

[52] U.S. Cl. ..... 282/11.5 A; 282/11.5 R; 229/69

[58] Field of Search ..... 206/610; 229/69, 70, 229/73, 105 R; 282/11.5 R, 11.5 A, 1 R

[56] References Cited

U.S. PATENT DOCUMENTS 3,905,545 9/1975 Juzeak et al. ..... 229/69

4,589,590 5/1986 McGuire et al. ..... 156/291

*Primary Examiner*—Paul A. Bell

*Assistant Examiner*—Thomas Hamill, Jr.

*Attorney, Agent, or Firm*—Wood, Dalton, Phillips, Mason & Rowe

[57] ABSTRACT

A variable purpose business form of the multiple ply type is provided by a construction including a plurality of superimposed plies 10, 12, 14, 16 and 18 including an upper ply 10 and a bottom ply 12 along with intermediate plies 14, 16 and 18. Glue lines 28 along one longitudinal edge of the plies 10, 12, 14, 16, 18 and secure each of the plies 10, 12, 14, 16, 18 together and first lines of weakness 26 are located in at least some of the plies 10, 12, 14, 16, 18 just inwardly of the glue lines 28. The upper and bottom plies 10, 12 have substantially equal width and a second glue line 36 at the opposite longitudinal edges of the upper and bottom plies 10, 12 secure the upper and bottom plies 10, 12 together. A second line of weakness 32 is disposed in the upper ply 10 adjacent the second glue line 36 and the intermediate plies 14, 16, 18 have different widths, all less than the upper and bottom plies 10, 12 and not greater than the distance between the one longitudinal edge and the second line of weakening 32. A cut-out 46, 50 is located in the upper ply 10 inwardly of the second line of weakening 32 for exposing the ends 40, 42, 44 of the intermediate plies 14, 16, 18.

11 Claims, 1 Drawing Sheet

MULTIPLE PLY BUSINESS FORM

FIELD OF THE INVENTION

This invention relates to business forms, and more particularly, to multiple ply business forms that may be used for a variety of different purposes including direct mail advertising, warranty materials, promotional offerings, etc. and the like.

BACKGROUND OF THE INVENTION

Business forms are utilized for a variety of communication purposes of a commercial nature. Depending upon the use, the form may take on any of a variety of constructions, and new constructions are generated on a frequent basis to meet new needs. Where the construction change involves no more than relocating printed indicia or the like, a business form intended originally for one use can be readily adapted for another. However, when one must change the location of glue lines, lines of weakness such as perforations, or change the dimensions of one or more of the plies that may go into a business form, or even the location of image transfer material used to transfer images from one ply to another as, for example, carbon, manufacturing changes must be made.

This is, of course, considerably more expensive than merely changing from one printing plate to another as would be the case where only the location or type of indicia must be changed. Moreover, in some cases, manufacturing changes require reeducation of manufacturing personnel and in some instances, relatively slow initial rates of manufacture so as to enable personnel to become experienced with the manufacturing method.

The present invention is directed to overcoming one or more of the above problems.

SUMMARY OF THE INVENTION

It is the principal object of the invention to provide a new and improved multiple ply business form. More specifically, it is an object of the invention to provide a multiple ply business form that may be utilized for a variety of purposes such as an advertising piece, a mailer, a data card, the presentation of warranty information, and many others.

An exemplary embodiment of the invention achieves the foregoing object in a construction including a plurality of superimposed plies which include an upper ply, a bottom ply and a plurality of intermediate plies. First means are located at one longitudinal edge of the plies and secure all of the plies together. First lines of weakening are located in at least some of the plies just inwardly of the first means and extend generally parallel to the one longitudinal edge so that individual ones of the plies having such a line of weakening may be separated from the remainder of the plies. The upper and bottom plies have substantially equal widths and second means are disposed at the longitudinal edges of the upper and bottom plies remote from the one longitudinal edge and secure the upper and bottom plies together. A second line of weakness is located in at least one of the upper and bottom plies adjacent to and generally parallel the remote longitudinal edge and just inwardly of the second securing means.

The intermediate plies have different widths, all less than the upper and bottom plies and not greater than the distance between the one longitudinal edge and the second line of weakening. A cut-out is located in one of the upper and bottom plies inwardly of the second line of weakening for exposing the ends of the intermediate plies nearest the second line of weakening.

This construction allows the manufacture of a very presentable, attention getting business form that may be utilized for any of a variety of purposes such as magazine and book subscription solutions, product announcements, bank and savings and loan customer contact, so-called "teasers" for subsequent mailings, warranty/guarantee activators, insurance solicitations, and many others.

According to a preferred embodiment of the invention, one of the intermediate plies is formed of card stock and includes return postcard indicia to thereby serve as a return postcard.

The invention contemplates that the second line of weakening and the cut-out be in the upper ply and that the length of the intermediate plies progressively increases as one proceeds from the uppermost intermediate ply toward the lowermost intermediate ply which is to say the intermediate plies are shingled.

In a highly preferred embodiment, the exposed ends of the intermediate plies bear different visible codes which can then be seen through the cut-out.

In an optimal embodiment of the invention, the different visible codes are different colors to provide an attention getting scheme.

The invention contemplates that the second line of weakening may be located in both the upper and bottom plies if desired. Preferably, the cut-out is triangular and extends toward one of the edges that interconnects the two longitudinal edges.

The invention also contemplates that image transfer materials such as carbon, or so-called coated front, coated back or even so-called "CFB" type image transfer mechanisms be employed at the interfaces of various ones of the plies.

Other objects and advantages will become apparent from the following specification taken in connection with the accompanying drawings.

DESCRIPTION OF THE PREFERRED EMBODIMENT

Figure 1:
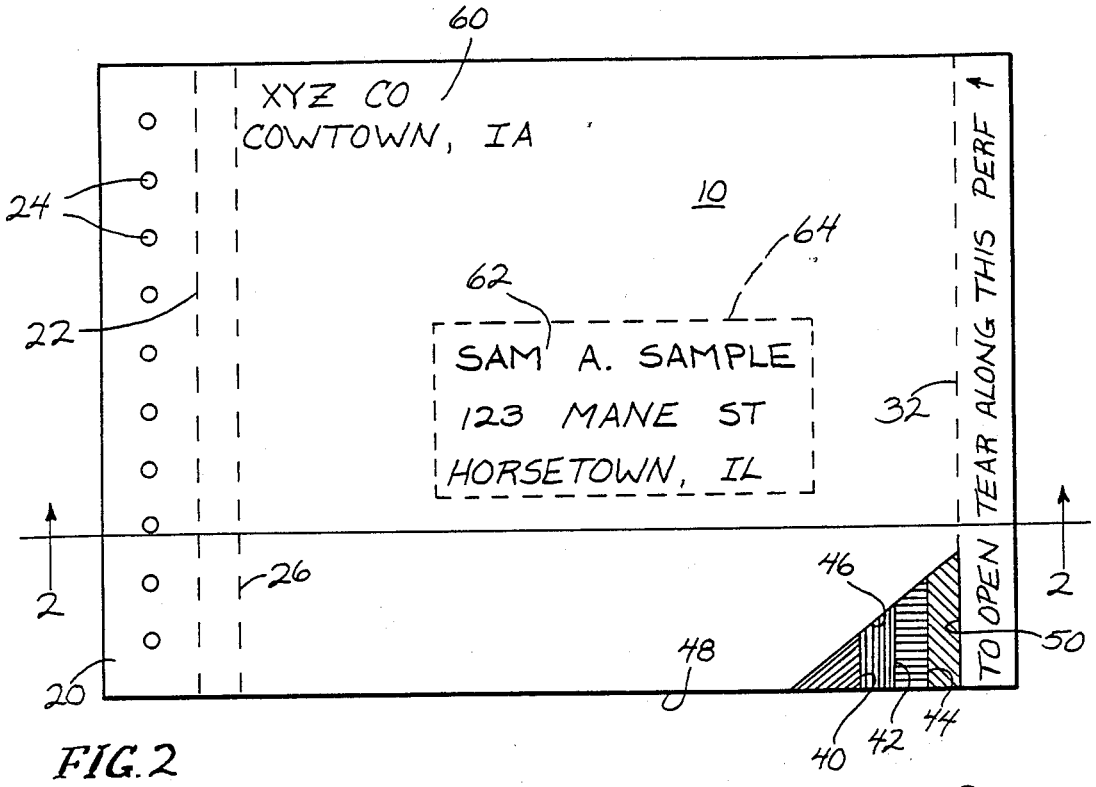
FIG. 1 is a plan view of a business form made according to the invention.

An exemplary embodiment of a business form made according to the invention is illustrated in the drawings and is susceptible to any of a variety of uses such as those mentioned previously as well as others that will readily occur to one skilled in the art. Thus, though the following discussion will refer to specific ones of those types of uses, it is to be understood that no specific limitation to any particular use is intended except insofar as contained in the appended claims.

Figure 2:
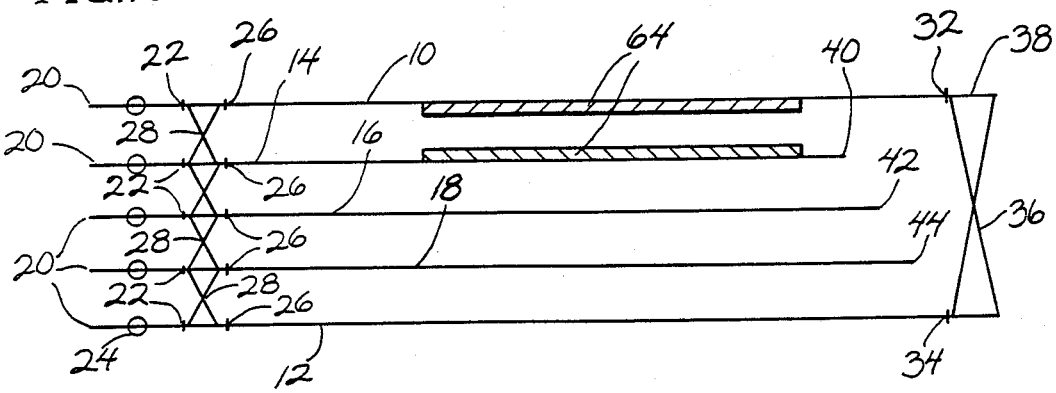
FIG. 2 is a somewhat schematic, sectional view of the business form taken approximately along the line 2—2 in FIG. 1.

Referring to FIGS. 1 and 2, the business form includes a plurality of superimposed plies including an upper ply 10, a bottom ply 12, and three intermediate plies 14, 16 and 18. As will be apparent, the number of intermediate plies could be increased from the three illustrated or, in some instances, it is conceivable that they may even be reduced to but two plies.

Each of the plies 10, 12, 14, 16 and 18 includes control punch margins 20 along the left hand edges that are utilized for manufacturing purposes as well as during the processing of the forms to apply variable information in a known manner. The control punch margins 20 may be of any type or size and may be removed from the form by stripping along a longitudinal line of weakening 22 that appears in each of the plies 10, 12, 14, 16 and 18. The control punch margins 20 include control punch openings 24 or line holes as is well known.

Just inwardly of the line of weakening 22 is a further line of weakening 26 which is located in each of the plies 10, 12, 14, 16 and 18 as is readily apparent from FIG. 2. Longitudinally extending glue lines 28 are at the interface of each of the plies i the assemblage between the lines of weakening 22 and 26, and are represented by "X's" as illustrated in FIG. 2. The glue lines 28 serve to secure the plies, 10, 12, 14, 16 and 18 together along their left hand longitudinal edges. Generally, glue will be utilized as the securing means but other securing means known in the art may be employed instead.

As can be seen from FIG. 2, the upper and bottom plies 10 and 12 preferably have the same width, that is, the dimension from one longitudinal edge to the other longitudinal edge of the form is the same, although in some instances different widths may be used.

Just inwardly of the right hand longitudinal edge, the upper ply 10 includes a line of weakening in the form of a perforation 32. In some cases, an aligned line of perforation 34 may be formed in the bottom ply 12 as well. Outwardly of the line of perforation 32 and inwardly of the right hand longitudinal edge of the plies 10 and 12 is a glue line 36 which secures the upper and bottom plies 10 and 12 only together along the right hand longitudinal edges thereof.

If the line of weakening 32 is made extremely weak, the line 34 may be omitted entirely. In such a case, it is only necessary to bend the tab 38 formed by that part of the plies 10 and 12 to the right of the line 32 downwardly to cause severance of the upper ply 10 at the line of weakening 32.

The intermediate plies 14, 16 and 18 will usually all have widths that are different from one another and which are less than the widths of the upper and bottom plies 10 and 12 and which further are shingled from top to bottom as is apparent in both FIGS. 1 and 2. Thus, the right hand edge or end 40 of the uppermost intermediate ply 14 is to the left of the corresponding edge 42 of the middle intermediate ply 16 which in turn is to the left of the end of edge 44 of the lowermost intermediate ply 18.

According to the invention, a triangular cut-out, best seen in FIG. 1, is provided in the upper ply 10. The cut-out is defined by a diagonally extending cut 46 that extends from the line of weakening 32 diagonally toward the lowermost edge 48 of the upper ply 10. It is also defined by a cut 50 which is a continuation of the line of weakening 32. The cut-out thus exposes the ends 40, 42 and 44 of the intermediate plies 14, 16, 18 remote from the line of perforation 26. To provide an extremely attractive and attention getting business form, the edges of the plies 14, 16, 18 adjacent the ends 40, 42, 44, and that portion of the bottom ply 12 immediately adjacent the line of weakening 34, if present, may be provided with different codes. As somewhat schematically illustrated in the drawings by different hatching, different color codes may be used. Because of the shingling of the ends 40, 42, 44, a rainbow-like effect will then result.

The top ply 10 may include return address information 60 if the business form is to be utilized as a mailer. Similarly, it may include an area 62 for receipt of recipient information which may be placed thereon by any variable printing process desired.

Where the form is intended to be imprinted with an impact printer, one or more of the plies 10, 14, 16 and 18 may be provided with image transfer material at their respective interfaces. For example, it may be desirable in some uses of the form to provide a rectangle of image transfer material 64 at the interface of the plies 10 and 14. This image transfer material may take on the form of hot spot carbons, or various coating systems known in the art. For that matter, interleaved carbon could be utilized if desired.

Figure 3:
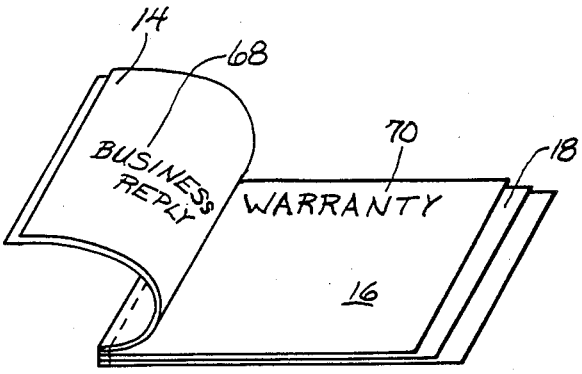
FIG. 3 is a perspective view of the business form after it has been opened by a recipient thereof.

In the specific form of the invention illustrated in the drawings, the ply 14 is formed of card stock and on its underside, may bear indicia 68 (FIG. 3) indicating that it is a business reply postcard or the like. The uppermost surface, that immediately under the ply 10, may receive the recipient information placed on the ply 10 as a result of the use of image transfer material 64 so the person receiving the business reply postcard will also be informed of the identity of the original recipient, and the person returning the business reply postcard will not have to go through the effort of completing recipient information thereon.

In some instances, the business form may not be utilized as a mailer, but may be included in the packaging for a product. In such a case, one of the plies, such as the ply 16 may include indicia 70 designating such as a warranty sheet. In this example, the ply 14 may still serve as a business reply postcard, seeking demographic information about the purchaser of the device for which the warranty is offered.

A variety of other uses will readily appear to those skilled in the art.

From the foregoing description, it will be appreciated that the construction described above and made according to the invention is ideally suited for a large variety of uses, whether or not as mailers. As a consequence, it is only necessary to change printing plates to adapt the business form for one use versus another and manufacturing changes and the accompanying difficulties are totally avoided.

I claim:

1. A business form comprising:

a plurality of superimposed plies, including an upper ply, a bottom ply and a plurality of intermediate plies;

first means at one longitudinal edge of said plies securing all of the plies together;

a first line of weakening in at least some of said plies just inwardly of said first means and extending generally parallel to said one longitudinal edge whereby individual ones of said some plies may be separated from the remainder of said plies;

said upper and bottom plies having substantially equal widths;

second means at the longitudinal edges of said upper and bottom plies remote from said one longitudinal edge securing said upper and bottom plies together;

a second line of weakening in at least one of said upper and bottom plies adjacent and generally parallel to said remote longitudinal edge and just inwardly of said second means;

said intermediate plies having different widths and not greater than the distance between said one longitudinal edge of said upper and bottom plies and said second line of weakening; and a cut-out in one of said upper and bottom plies inwardly of said second line of weakening for exposing the ends of said intermediate plies nearest said second line of weakening.

2. The business form of claim 1 wherein one of said intermediate plies is formed of card stock and includes return postcard indicia.

3. The business form of claim 1 wherein said second line of weakening and said cut-out are in said upper ply and the length of said intermediate plies progressively increases as one proceeds from the uppermost intermediate ply toward the lowermost intermediate ply.

4. The business form of claim 3 wherein said exposed ends of said intermediate plies bear different visible codes.

5. The business form of claim 4 wherein said different visible codes are different colors.

6. The business form of claim 1 wherein said exposed ends of said intermediate plies bear different visible codes.

7. The business form of claim 6 wherein said different visible codes are different colors.

8. The business form of claim 1 wherein said second line of weakening is located in both said upper and bottom plies.

9. The business form of claim 1 wherein said second line of weakening and said cut-out are in said upper ply and said cut-out is defined by a cut in said upper ply extending diagonally from said second line of weakening to an edge of said upper ply which in turn extends between said one edge and said remote edge.

10. A business form comprising:

a plurality of superimposed plies, including an upper ply, a bottom ply and a plurality of intermediate plies;

first means at one longitudinal edge of said plies securing all of the plies together;

first lines of weakening in at least some of said plies just inwardly of said first means and extending generally parallel to said one longitudinal edge whereby individual ones of said some plies may be separated from the remainder of said plies;

said upper and bottom plies having substantially equal widths;

second means at the longitudinal edges of said upper and bottom plies remote from said one longitudinal edges securing said upper and bottom plies together;

a second line of weakening in at least ne of said upper and bottom plies adjacent and generally parallel to said remote longitudinal edge and just inwardly of said second means;

said intermediate plies having different widths, all less than said upper and bottom plies and not greater than the distance between said one longitudinal edges and said second line of weakening; and a triangular cut-out extending to a further edge of said upper ply for exposing the ends of said intermediate plies nearest said second line of weakening;

said exposed ends being shingled from top to bottom of said form and having differing color coding.

11. The business form of claim 10 further including image transfer material at the interface of at least some of said plies.

* * * * *